US008944858B2

(12) United States Patent
Schmidt et al.

(10) Patent No.: US 8,944,858 B2
(45) Date of Patent: Feb. 3, 2015

(54) ELECTRICAL POWER TERMINAL FASTENED TO A WIRE CONNECTION MEMBER

(75) Inventors: Rainer Schmidt, Nuremberg (DE); Thomas Bernhard Pabst, Nuremberg (DE)

(73) Assignee: Delphi International Operations Luxembourg, S.A.R.L. (LU)

( * ) Notice: Subject to any disclaimer, the term of this patent is extended or adjusted under 35 U.S.C. 154(b) by 136 days.

(21) Appl. No.: 13/817,550

(22) PCT Filed: Aug. 10, 2011

(86) PCT No.: PCT/IB2011/002084

§ 371 (c)(1), (2), (4) Date: Mar. 28, 2013

(87) PCT Pub. No.: WO2012/023041

PCT Pub. Date: Feb. 23, 2012

(65) Prior Publication Data

US 2013/0210292 A1 Aug. 15, 2013

(30) Foreign Application Priority Data

Aug. 19, 2010 (WO) ..... PCT/IB2010/002446

(51) Int. Cl.

| | |
|---|---|
| ***H01R 4/28*** | (2006.01) |
| ***H01R 13/15*** | (2006.01) |
| ***H01R 4/06*** | (2006.01) |
| ***H01R 11/12*** | (2006.01) |
| ***H01R 13/05*** | (2006.01) |

(52) U.S. Cl.

CPC ..... *H01R 13/15* (2013.01); *H01R 4/06* (2013.01); *H01R 11/12* (2013.01); *H01R 13/052* (2013.01); *H01R 2201/26* (2013.01)

USPC ..... 439/754

(58) Field of Classification Search

USPC ..... 439/754, 775, 686

See application file for complete search history.

(56) References Cited

U.S. PATENT DOCUMENTS

| | | | | |
|---|---|---|---|---|
| 2,925,579 | A * | 2/1960 | Osborn | 439/388 |
| 2,988,725 | A * | 6/1961 | Vallee | 439/556 |
| 5,667,413 | A | 9/1997 | Trafton | |
| 6,817,907 | B2 * | 11/2004 | Cheng et al. | 439/754 |
| 6,965,671 | B2 * | 11/2005 | Kao et al. | 379/438 |
| 7,234,979 | B2 * | 6/2007 | Fujii | 439/754 |

(Continued)

FOREIGN PATENT DOCUMENTS

| | | | |
|---|---|---|---|
| EP | 1282191 | A2 | 2/2003 |
| WO | 2010029391 | A1 | 3/2010 |

OTHER PUBLICATIONS

International Search Report dated Jan. 2, 2012.

*Primary Examiner* — Chandrika Prasad
(74) *Attorney, Agent, or Firm* — Robert J. Myers

(57) ABSTRACT

The present invention relates to an electrical 90° power terminal, comprising an elongated wire connection member, and a terminal element. The wire connection member is provided with a wire fastening portion and a fastening portion for the terminal element comprising a circular opening, and the terminal element has an essentially cylindrical shape and comprises a terminal end and a connecting end adapted to be received in the circular opening of the fastening portion. When connected with each other, the terminal element and the elongated wire connection member are arranged essentially perpendicular to each other.

13 Claims, 7 Drawing Sheets

(56) References Cited

U.S. PATENT DOCUMENTS 8,597,062 B2 * 12/2013 Casses et al. ..... 439/686
2005/0181664 A1 * 8/2005 Fukuzaki et al. ..... 439/521
2007/0066149 A1 * 3/2007 Fujii ..... 439/754
2011/0177722 A1 * 7/2011 Casses et al. ..... 439/660

* cited by examiner

ELECTRICAL POWER TERMINAL FASTENED TO A WIRE CONNECTION MEMBER

CROSS-REFERENCE TO RELATED APPLICATIONS

This application is a national stage application under 35 U.S.C. §371 of PCT Application No. PCT/IB2011/002084 having an international filing date of Aug. 10, 2011, which designated the United States, which PCT application claimed the benefit of PCT Application No. PCT/IB2010/002446, filed Aug. 19, 2010, the entire disclosure of each of which are hereby incorporated herein by reference.

FIELD OF THE INVENTION

The invention relates to electrical power terminals, in particular for the application in electrical or hybrid passenger vehicles.

BACKGROUND OF THE INVENTION

Electrical power terminals or connectors are used to connect electrical appliances with each other and in particular to transmit the necessary electrical power between a power source, as for example a battery or generator, and an electric device as for example an electric motor. In particular when used in connection with passenger vehicles, such electrical power connectors often have to fulfill certain strict requirements. This is in particular true in the case of electrical powered vehicles or so called "hybrid" vehicles, which combine ordinary fuel powered engines with additional, usually auxiliary, electrical motors to reduce the fuel consumption of the vehicle. The electrical power supply necessary for such electrically driven vehicles or hybrid vehicles is considerably larger than with ordinary fuel driven vehicles, which only need electrical power for example for certain comfort or safety features, but not for the propulsion of the vehicle itself. Thus, the commonly used electrical power terminals of ordinary fuel driven vehicles are not usable in connection with the high current or voltage necessary for electrical or hybrid vehicles. The electrical terminals as well as the wiring in electrical or hybrid cars have to be dimensioned more massively, which increases not only the costs but also the problems associated with the larger space requirements of such terminals and the corresponding wiring. For example, due to the larger diameter of the power supply lines, which is in the range of several mm, as for example 10 mm, the bending radius of such a cable is necessarily comparably large, which is highly problematic in the cramped engine compartments of modern passenger vehicles. This is even more true for electrical or hybrid systems in which space is a particular problem due to the large size of the required batteries and/or due to the fact that two drive units have to be arranged somewhere in the vehicle.

It is therefore an object of the present invention to provide an electrical power terminal which is cost efficient to produce, requires only minimum installation space and is nevertheless suitable to be used in connection with high current/voltage applications, as in particular occurring in electrical or hybrid driven passenger vehicles. It is a further object of the invention to provide such a power terminal which is flexible in use and which can be easily and cost effectively adapted to different application situations, as for example in different models of electrical or hybrid vehicles, like for example from different manufacturers. It is still a further object of the invention to achieve all of the above with a power terminal, which is easy to assemble. These and other objects, which become apparent upon reading the following description, are solved by an electrical 90° power terminal according to claim 1 and a connector system according to claim 12.

BRIEF SUMMARY OF THE INVENTION

According to the invention, an electrical power terminal is provided comprising at least two parts preferably adapted to be assembled with each other: an elongated wire connection member and a corresponding terminal element. Thus, the power terminal is made from two distinct parts and has a modular design, such that for example the same wire connection member may be used with different terminal elements, so that the terminal element may be exchanged for different applications in for example different vehicles but the wire connection member is standardized and thus usable in any kind of situation. The wire connection member is for example made from a piece of stamped sheet metal. It has in any case a wire fastening portion for the attachment of a wire or cable and a terminal fastening portion, preferably at the opposite end of the connection member in relation to the wire fastening portion, which comprises a round opening for the reception of a part of the terminal element. The terminal element of the present invention has essentially cylindrical shape and comprises a terminal end and a connecting end, whereby the connecting end is adapted to be received in the round, in particular circular opening of the fastening portion for the terminal element. Thereby, upon connecting, the terminal element and the elongated wire connection member are arranged essentially perpendicular to each other so that the necessity to bend e.g. an electrical power cable is eliminated. The diameter of the terminal element is reduced at the connecting end thereof compared to the main body of the essentially cylindrical terminal element. Then this external dimension of the terminal fastening portion can be reduced to as to not extend laterally (except in the portion linked to the wire fastening portion) more than the external diameter of the terminal element, though it remains material for a robust connection of the terminal element with the wire connection member. Such a feature allows in particular saving a significant room when several connectors according to the invention are placed side by side. Thereby, a particular compact design is realized, which is nevertheless stable and strong enough to fulfill all the necessary mechanical requirements in particular in automotive applications.

In a preferred embodiment, the round, in particular circular opening of the fastening portion for the terminal element provided in the wire connection member is dimensioned so that upon connection with each other, a press fit holds the two members mechanically together. The press fitting may alternatively be supported by an additional welding process, as for example one or two welding spots. In any case, welding or solder connections are possible.

In a further preferred embodiment, the terminal element is formed from a piece of rolled sheet metal. In this way, the cylindrical shape of the terminal element can be provided in a very economic manner. Preferably, the outer diameter of the connecting end of the terminal element is slightly larger than the inner diameter of the round, in particular circular opening, whereby the respective diameters are chosen that it is still possible to insert the connecting end into the opening when sufficient force is applied. If the terminal element is formed from a rolled piece of sheet metal it is preferred that a gap remains at the joint of the two adjacent edges of the piece of sheet metal, at least at the connecting end of the terminal element. Due to the gap it is possible to elastically press the connecting end upon insertion into the round in particular circular opening of the elongated wire connection member, thereby facilitating the assembly process.

To improve the mechanical connection between the wire connection member and the terminal element it is preferred that the round, in particular circular opening is surrounded by a cylindrical collar projecting perpendicular from the plane defined by the round opening. In this way the terminal surface between wire connection member and terminal element is increased, which leads in particular in the case of a press fitting engagement to increased holding forces between terminal element and wire connection member.

Preferably, the wire connection member is provided with a step between the wire fastening portion and the fastening portion for the terminal element. This step allows a particular compact design of the inventive power terminal, in particular if an additional sealing member is provided around the wire connection member. Then the total height of the terminal does not exceed the height of the terminal element. However, is that the step offers the possibility for an additional locking feature and/or an additional Terminal Position Assurance (TPA) member. By introducing a locking element as e.g. a locking slider or bar into the edge formed by the step after mounting of the terminal inside of a connector housing, it can be prevented that the terminal is unintentionally removed again from its correct position in the housing. Likewise, if constructed accordingly, one can make sure that the locking element can only be introduced into the edge formed by the step if the terminal is correctly positioned in its respective housing (TPA functionality).

In a further preferred embodiment, the power terminal further comprises a cylindrical hood which is adapted to be arranged coaxially around the terminal element. The cylindrical hood serves preferably as mechanical connecting means of the power terminal in a corresponding connector housing. It can further increase the terminal forces applied from the terminal element onto a corresponding counter terminal element. The hood is preferably made from conductive metal, in particular from a rolled piece of sheet metal.

The inventive design of the electrical power terminal allows a flexible application of the power terminal due to its modular design and the simple mounting process. Since the connecting end of the terminal element is preferably held in the round opening of the terminal fastening portion by a press fitting engagement it is possible to dismount the terminal element from the wire connection member, for example for service purposes. Still further, due to the two distinct parts forming the inventive power terminal it is possible to choose different materials for the two members, each being optimized for its respective purpose.

BRIEF DESCRIPTION OF THE SEVERAL VIEWS OF THE DRAWING

In the following, the invention is described exemplarily with reference to the enclosed figures, in which.

DETAILED DESCRIPTION OF THE INVENTION

Figure 1:
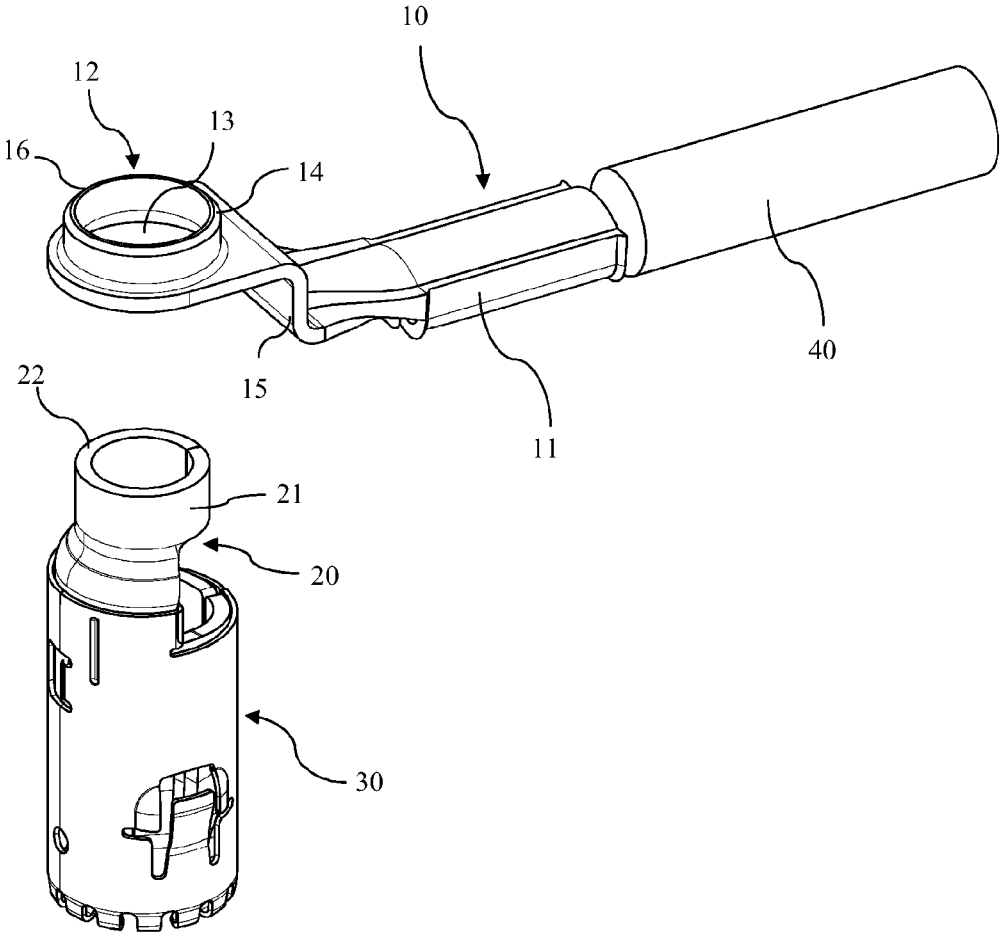
FIG. 1 shows a schematic illustration of a power terminal in accordance with the invention.

FIG. 1 is a schematic illustration of an exemplary electrical 90° (orthogonal) power terminal in accordance with the invention. The power terminal comprises an elongated wire connection member 10 as well as a terminal element 20. The wire connection member 10 is made from a stamped and bent piece of sheet metal (copper, aluminum, metal alloy, etc.) and is provided with a wire fastening portion 11 on one end and a terminal fastening portion 12 onto the terminal element 20, on the opposite end thereof. In the figures, a power line cable 40 is schematically shown, which is attached to the wire fastening portion 11 by means of a crimping or welding operation. The terminal fastening portion 12 comprises a circular opening 13 which is adapted to receive a connecting end 21 of the terminal element 20. The circular opening 13 is surrounded by a collar 14 which is of essentially cylindrical shape and projects upwardly from the plane of the circular opening 13 as one can see from FIG. 1. In assembled condition, the collar 14 will surround the connecting end 21 of the terminal element 20 and improve the mechanical stability of the connection and the mechanical joint of the wire connecting member 10 with the terminal element 20. As one can see from FIG. 1, the wire connection member 10 is provided with a step 15 between the wire fastening portion 11 and the terminal fastening portion 12. Due to this step 15, the wire fastening portion 11 is arranged in a different plane than the terminal fastening portion 12. Thus, in assembled condition the outer edge 16 of collar 14 is the uppermost portion of the power terminal and the assembled construction has a particular compact design.

Figure 2:
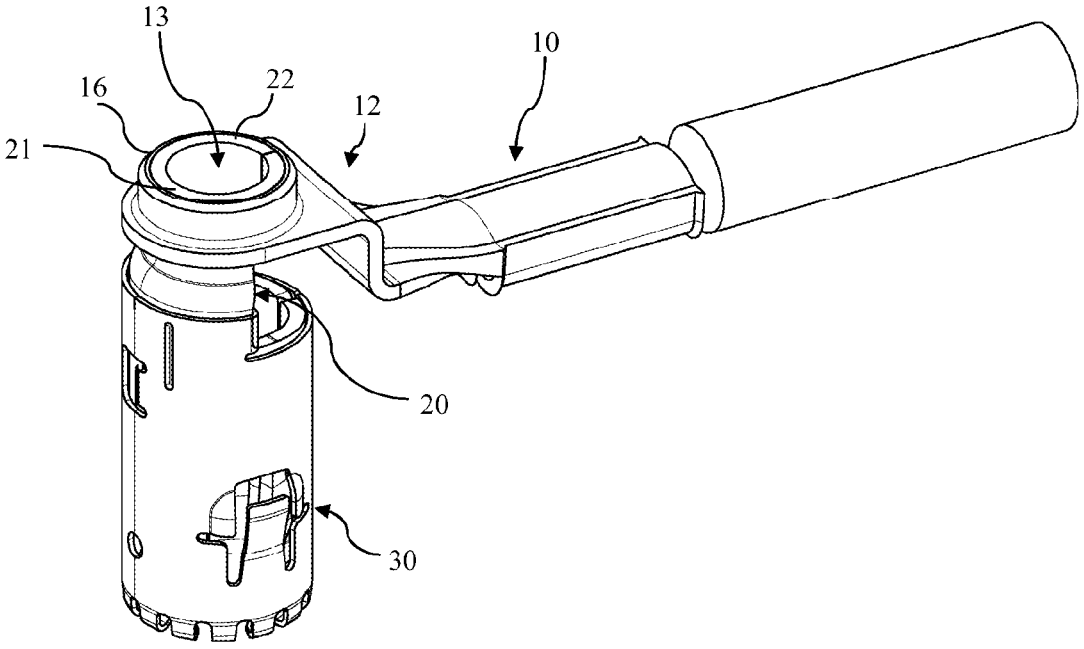
FIG. 2 shows the same power terminal as FIG. 1 in assembled condition.

FIG. 2 shows the power terminal of FIG. 1 in assembled condition. The terminal element 20 with the optional hood 30 is mounted to the wire connection member 10 by inserting the connecting end 21 into the circular opening 13 of the connection member. Due to the modular design it is possible to use different terminal elements with the same, standardized wire connection member. Only the connecting end 21 is preferably always the same and is preferably standardized, whereas the terminal end can be chosen as desired or necessary.

Figure 3:
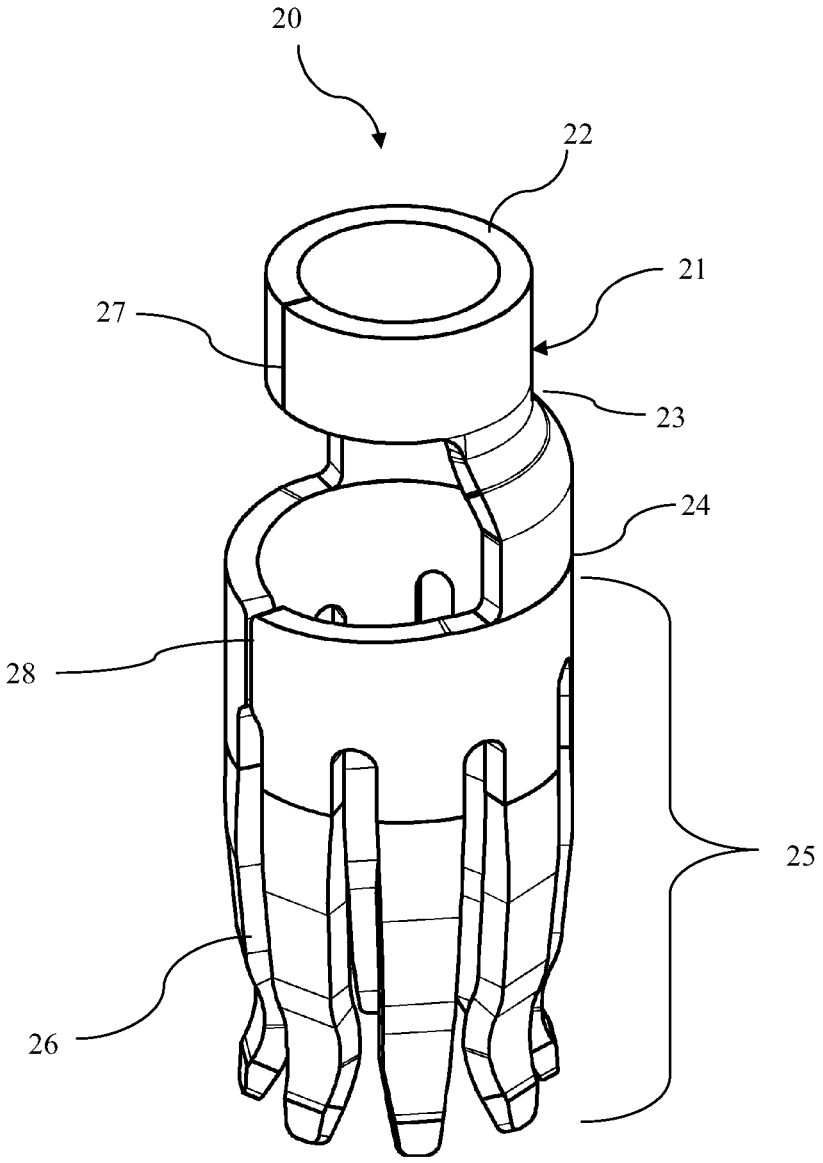
FIG. 3 is a schematic illustration of a terminal element in accordance with the invention.

As one can see from FIG. 3, the terminal element 20 has an essentially cylindrical shape and the (standardized) connecting end 21 thereof is adapted to be received in the circular opening 13. One can further see from the figures that the diameter of the cylindrical terminal element 20 is reduced at the connecting end 21 compared to the main body of the terminal element 20. Thereby, as shown in FIG. 2, the construction is particular compact and the terminal fastening portion 12 has approximately the same outer dimension than the outer diameter of hood 30. Without the reduced diameter of the connecting ends 21, the fastening portion 12 would be necessarily larger than the outer diameter of the terminal element 20 (respectively the optional hood 30). Further, the reduced diameter provides a defined stop member upon insertion of the connecting end 21 into the circular opening 13 so that the outer edge 22 of the connecting end 21 will be flush with the outer edge 16 in assembled condition, as one can see from FIG. 2. The circular opening 13 offers further a possibility to incorporate a secondary locking feature as will be explained in more detail below under reference to FIGS. 6A and 6B.

Turning back to FIG. 3, the connecting end 21 has essentially a cylindrical shape and extends downwardly to a broadening 23. The broadening 23 merges into the main body of the terminal element 20 at position 24 in FIG. 3. The main body of the terminal element 20 consists of the terminal end 25, which is formed by a plurality of elastic spring arms 26. The elastic spring arms 26 are arranged essentially coaxially with the longitudinal axis of the cylindrical terminal element 20 and are adapted to receive for example a corresponding terminal pin of a corresponding counter connector (not shown). The elastic spring arms 26 are shaped so that upon insertion of a corresponding terminal pin, the arms will be bent slightly radially outward and due to their elastic spring properties will mechanically hold the terminal pin in engagement.

As the skilled person will recognize, the exemplary terminal element 20 shown in the figures is formed from a piece of stamped and rolled sheet metal (copper, aluminum, metal alloy, etc.). Preferably, a gap 27 remains at the joint of the two adjacent edges of the piece of sheet metal at least at the connecting end 21 of the terminal element 20. Thereby it is possible to compress the connecting end 21 to a certain extend, which facilitates the insertion thereof into the circular opening 13. In the embodiment shown, the terminal end 25 of the terminal element 20 is also provided with such a gap 28 offering a similar function upon insertion of a corresponding terminal pin.

Figure 4:
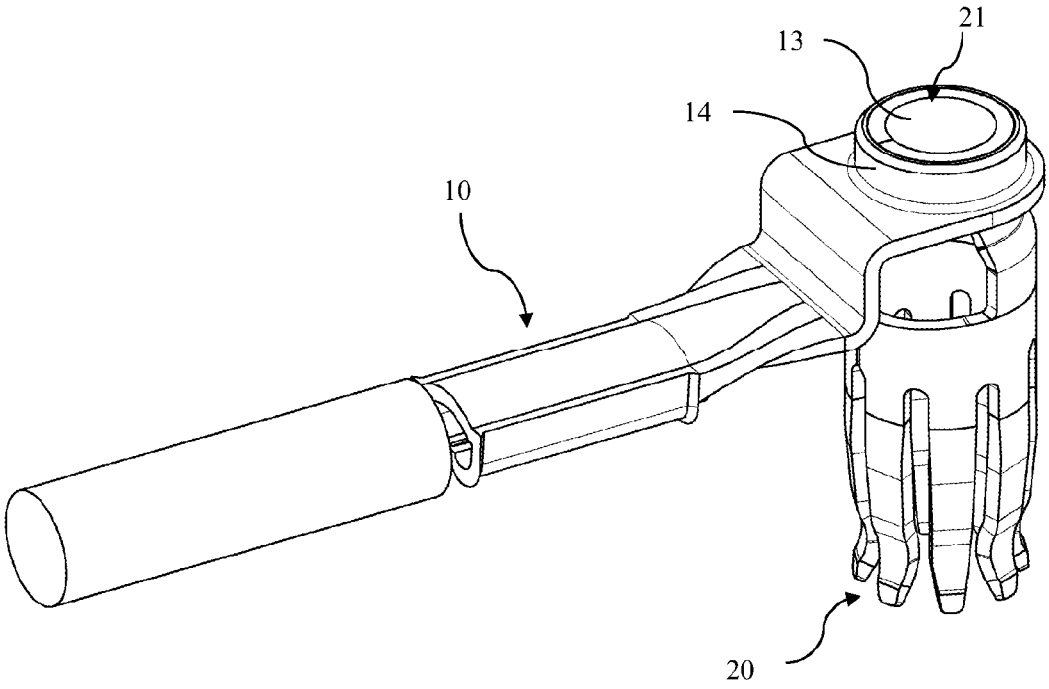
FIG. 4 is a schematic illustration showing the terminal element of FIG. 3 assembled with an elongated wire connection member.

FIG. 4 shows the same construction as FIGS. 1 and 2 but without the hood 30. The hood 30 supports the spring forces of the elastic spring arms 26 since it prevents the elastic spring arms 26 from an excessive outwardly directed movement. The outer diameter of the connecting end 21 is preferably larger than the inner diameter of the circular opening 13, respectively the collar 14. Thereby, it is possible to realize a press fitting between the wire connection member 10 and the terminal element 20. Obviously, the respective diameters have to be chosen so that it is still possible to insert the connecting end 21 into the circular opening 13 upon using sufficient force. Thus, in the condition shown in FIGS. 2 and 4, a press fitting between connecting end 21 and circular opening 13, respectively collar 14, is sufficient and it is not necessary to secure the connecting by additional means, as for example welding spots.

Figure 5:
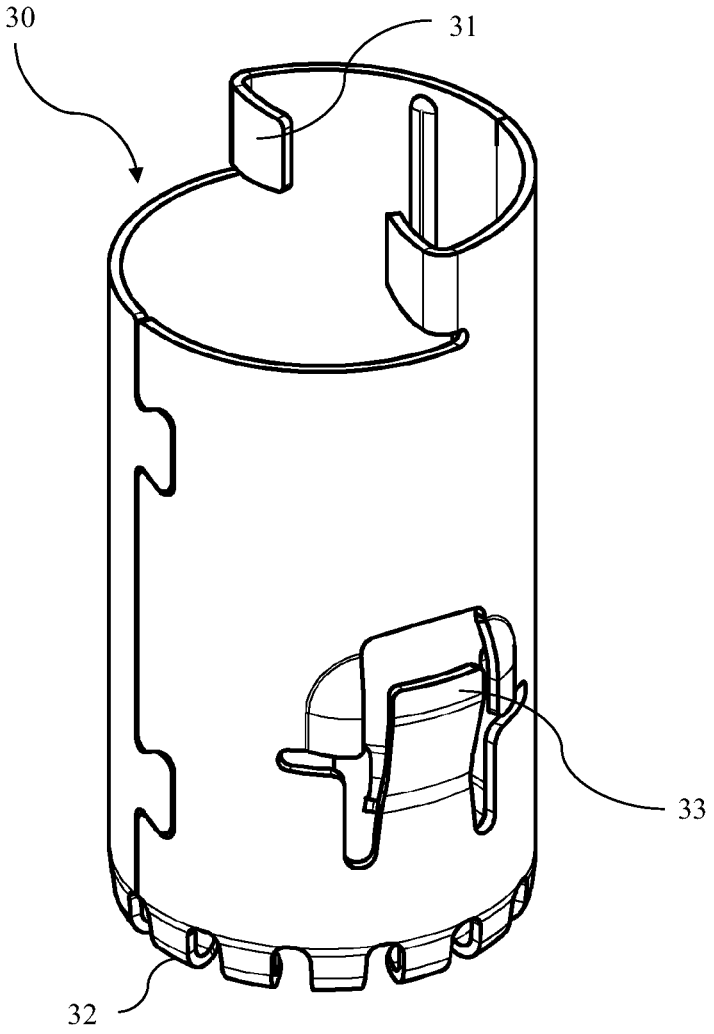
FIG. 5 is a schematic illustration showing a hood which may be used in connection with the present invention.

FIG. 5 shows the hood 30 in disassembled condition. As one can see, also hood 30 is an essentially cylindrical element and, as the skilled person will recognize, made from a piece of stamped and rolled sheet metal (e.g. steel). The hood 30 is in all the embodiments described herein preferably electro-conductive. At one end thereof, the hood 30 is provided with inwardly bent flanges 31 which serve to fasten the hood 30 on the terminal element 20. In the initial condition of the hood 30, the flanges 31 are not yet bent inwardly but are essentially parallel to the main circular body of the hood 30. Only after mounting the hood 30 on the terminal element 20, the flanges 31 are mechanically bent inwardly thereby fixing the hood 30 on the terminal element 20. The hood 30 is further provided with inwardly bent teeth 32, which provide a defined stop so that upon assembly of the hood 30 and terminal element 20, it is only possible to insert the terminal element 20 from the top side (the expression "top side" is meant as shown in the figures; in practice the power terminal can of course be used in any spatial orientation) and the insertion of terminal elements 20 into hood 30 is stopped when the tips of the elastic spring arms 26 touch the inwardly bent teeth 32 of hood 30. Further, the hood 30 is provided with latching arms 33, which are cut out of the main body of the hood 30 and are bent slightly radially outward. The latching arms 33 serve for example to fix the arrangement of terminal element 20 and hood 30 inside of a housing of a connector, by latching for example into a corresponding recess or behind a corresponding shoulder arranged in the housing of the connector.

Figure 6A:
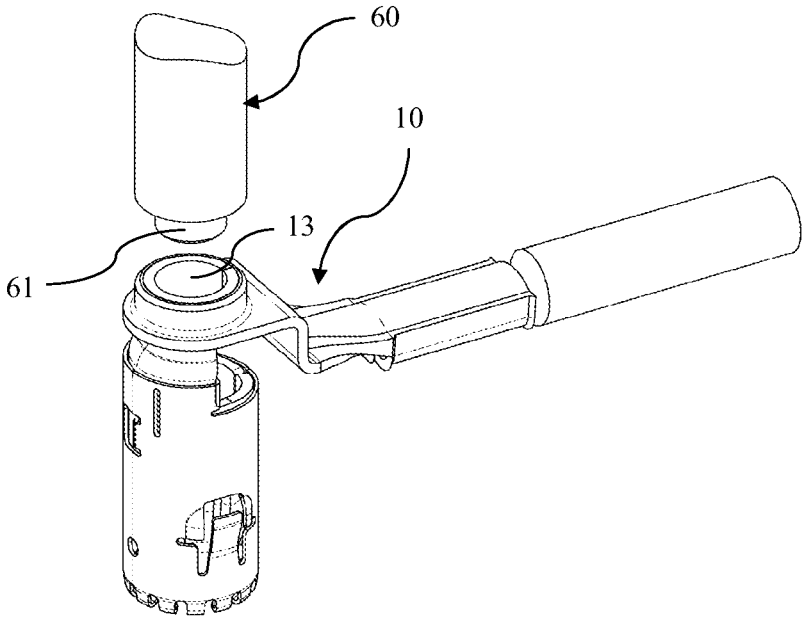
FIGS. 6A and 6B are schematic illustrations showing the application of a secondary locking or TPA feature.
Figure 6B:
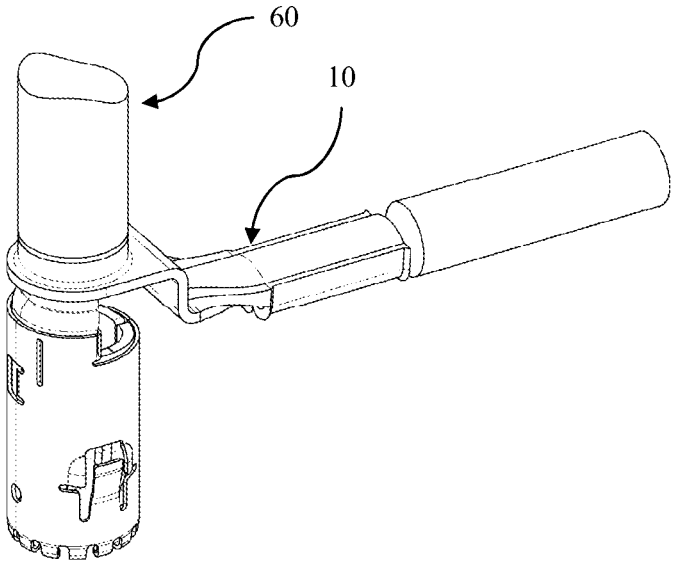

FIGS. 6A and 6B are schematic illustrations showing the application of a secondary locking or TPA feature. Reference numeral 60 denotes a locking pin 60, which may be part of a TPA member being arranged on a connector housing (not shown) in which the terminal is mounted. The terminal shown can be mounted to or into any kind of suitable connector housing, as e.g. a plug connector housing. The locking pin 60 is provided with a circular locking protrusion 61 adapted to fit in the circular opening 13. This is shown in FIG. 6B. The locking pin 60 can thus serve two functions: for one it may lock the terminal in its position in the housing and secondly it may serve to verify whether the terminal is correctly mounted in a housing or not. Since protrusion 61 fits tightly into circular opening 13 it is only possible to insert the protrusion 61 therein when and if the whole terminal is correctly positioned with respect to locking pin 60, which is only the case when the terminal is in its correct and designated position in the housing.

Figure 7A:
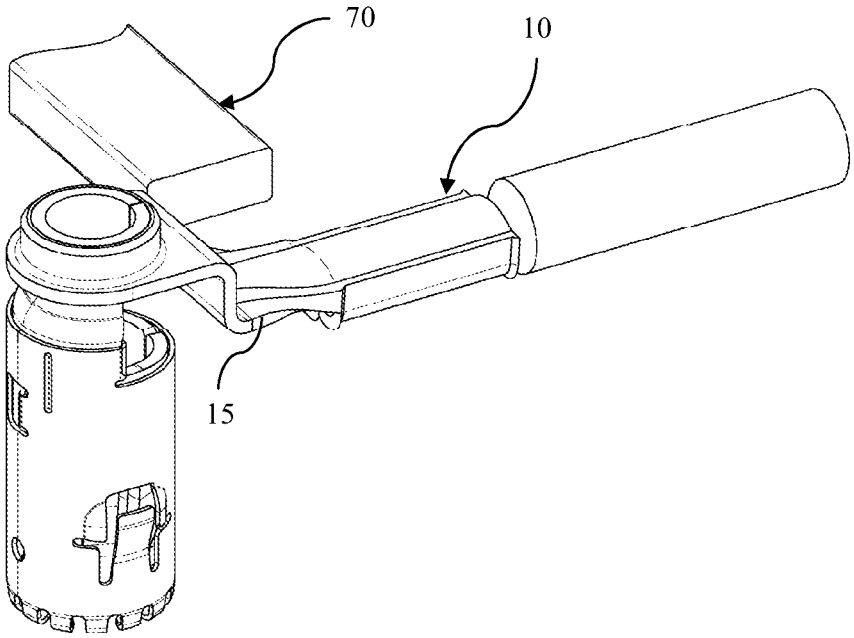
FIGS. 7A and 7B show an alternative secondary locking respectively TPA feature.
Figure 7B:
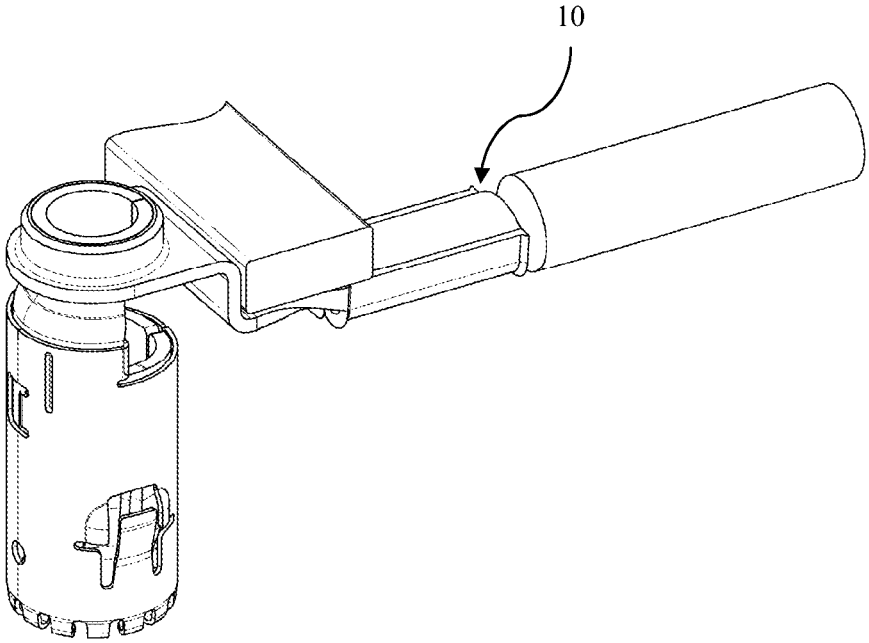

FIGS. 7A and 7B show an alternative secondary locking respectively TPA feature. In the embodiment shown, the feature is realized by means of a locking element in form of a locking slider 70, which may likewise be part of a TPA member and which is in any case adapted to be arranged on the connector housing in which the terminal is mounted. By moving the locking slider 70 from the open position shown in FIG. 7A to the closed position in FIG. 7B the terminal can be locked in its respective position in the housing (again not shown). The locking slider 70 is moved into the edge formed by step 15 after the terminal is mounted inside of a connector housing and thus prevents that the terminal is unintentionally removed from its correct position in the housing. Thus, the step 15 can be used to provide an additional locking function as well as to provide a TPA function.

The invention claimed is:

1. An electrical power terminal, comprising:

an elongated wire connection member provided with a wire fastening portion and a terminal fastening portion comprising a circular opening; and a terminal element with a main body having an essentially cylindrical shape, axially extended in a direction substantially perpendicular to a longitudinal direction of the elongated wire connection member, when connected to each other, the terminal element comprising a terminal end and a connecting end adapted to be received in the circular opening, wherein a diameter of the terminal element is reduced at the connecting end compared to the main body of the terminal element.

2. The terminal of claim 1, wherein the elongated wire connection member and the terminal element are two distinct parts adapted to be mechanically connected with each other by inserting the connecting end into the circular opening.

3. The terminal of claim 1, wherein the elongated wire connection member and the terminal element are connected with each other by means of a press-fitting between the circular opening and the connecting end.

4. The terminal of claim 1, wherein the terminal element is formed from a piece of rolled sheet metal.

5. The terminal of claim 1, wherein an outer diameter of the connecting end is larger than an inner diameter of the circular opening.

6. The terminal of claim 5, wherein the respective diameters are chosen so as to press-fit the connecting end in the circular opening.

7. The terminal of claim 1, wherein the terminal element is formed from a piece of rolled sheet metal and a gap exists at a joint of two adjacent edges of the piece of rolled sheet metal at the connecting end thereby allowing an elastic compression of the connecting end.

8. The terminal of claim 1, wherein the circular opening is surrounded by a cylindrical collar projecting perpendicular from a plane defined by the circular opening.

9. The terminal of claim 1, wherein at least one step is provided in the elongated wire connection member between the wire fastening portion and the terminal fastening portion.

10. The terminal of claim 9, wherein the step is adapted for reception of a secondary locking element.

11. The terminal of claim 1, wherein the circular opening is adapted for reception of a secondary locking pin.

12. A connector system comprising:

a terminal according to claim 9;

a housing for accommodating such a terminal; and a Terminal Position Assurance (TPA) device, the TPA device engaging at least one of the circular opening and the step.

13. A connector system comprising:

a terminal according to claim 11;

a housing for accommodating such a terminal; and a Terminal Position Assurance (TPA) device, the TPA device engaging at least one of the circular opening and the step.

* * * * *